US006341557B1

(12) United States Patent
Hutchison et al.

(10) Patent No.: US 6,341,557 B1
(45) Date of Patent: Jan. 29, 2002

(54) NON-FERROUS/FERROMATIC LAMINATED GRAPHIC ARTS IMPRESSION DIES AND METHOD OF PRODUCING SAME

(75) Inventors: Glenn E. Hutchison, Prairie Village; Todd E. Scholtz, Olathe, both of KS (US)

(73) Assignee: Universal Engraving, Inc., Overland Park, KS (US)

( * ) Notice: Subject to any disclaimer, the term of this patent is extended or adjusted under 35 U.S.C. 154(b) by 0 days.

(21) Appl. No.: 09/501,155

(22) Filed: Feb. 9, 2000

Related U.S. Application Data

(63) Continuation-in-part of application No. 09/392,179, filed on Sep. 9, 1999.

(51) Int. Cl.[7] ..... B41F 27/00

(52) U.S. Cl. ..... 101/389.1; 72/482.9; 156/272.4; 216/36; 216/41; 216/105

(58) Field of Search ..... 216/8, 9, 10, 36, 216/41, 102, 105; 101/28, 32, 34, 454, 458, 465, 401.1, 389.1; 72/482.9, 707; 156/272.4, 60, 196, 277, 384, 581

(56) References Cited

U.S. PATENT DOCUMENTS 3,782,166 A * 1/1974 Whistler, Jr. et al. ..... 72/462

(List continued on next page.)

FOREIGN PATENT DOCUMENTS

JP 2000202548 * 7/2000 ..... B21D/37/20

OTHER PUBLICATIONS

R. Blickensderfer, "Cladding Metals by Continuous Strip Rolling in Vacuum," *Bureau of Mines Report of Investigations/1980*, United States Department of Interior, pp. 1–11.

(List continued on next page.)

*Primary Examiner*—Randy Gulakowski
*Assistant Examiner*—Allan Olsen
(74) *Attorney, Agent, or Firm*—Hovey, Williams, Timmons & Collins

(57) ABSTRACT

This invention relates to a relatively thin cladded graphic arts impression graphic arts impression die plate (20) having a steel layer (22) which is integral throughout the extent thereof with a layer of copper (24) or bronze. A relieved design-defining surface may be formed in the copper or bronze layer by a chemical etching process or by chemical milling. In the case of chemical etching of the graphic arts impression die plate (20), a design-defining layer of photoresist is applied to the outer surface of the copper layer (24) or the bronze layer and the relieved design is formed in the copper or bronze layer using a conventional ferric chloride etching solution. The etched graphic arts impression die plate may be mounted on an etchant-resistant backing or magnetic support member (28) to present an assembly which increases the thickness of the die assembly sufficiently to permit use thereof on standard stamping and embossing equipment without modification of the die-supporting chase. The magnetic support member (28) has a plurality of pairs of permanent magnets (33, 35) each pair of which is embedded within a respective cavity (32) and that are magnetically bridged by a steel plate (36). The pairs of magnets (33 and 35) attract the steel layer (22) of the graphic arts impression die plate (20) and thereby hold the graphic arts impression die plate on the magnetic support member (28). Etching of a blank cladded metal graphic arts impression die plate (20) is facilitated by provision of a rotatable magnetic support member (64, 164, 264, 364) within die etching apparatus (40) which serves to support the die blank while it is being subjected to the etchant solution. The die blank magnetic support member (64, 164, 264, 364) has permanent magnets (78, 178, 278, 378) embedded therein, or altematively pairs of magnets each pair of which is bridged by a steel plate, which magnetically attract the steel layer (22) of the graphic arts impression die plate (20) to affix the graphic arts impression die plate to the magnetic support member.

27 Claims, 5 Drawing Sheets

U.S. PATENT DOCUMENTS

| | | | | | |
|---|---|---|---|---|---|
| 4,564,414 | A | * | 1/1986 | Houssian et al. | 156/541 |
| 5,364,494 | A | | 11/1994 | Hutchison et al. | 156/642 |
| 5,399,217 | A | * | 3/1995 | Bloom | 156/219 |
| 5,904,096 | A | | 5/1999 | Fawcett et al. | 101/389.1 |

OTHER PUBLICATIONS

E. Romhanji, V. Radmilovic, V. Milenkovic and Dj. Drobnjak, "Deformation Behaviour of a Brass/Steel/Brass Sandwich Sheet Composite," *Coatings and Bimetallics for Aggressive Environments*, American Society for Metals, Nov. 1984, pp. 53–60.

Tylecote, R.F., "The Solid Phase Welding of Metals," St. Martin's Press, 1968.

R. Baboian and G. Haynes, "Corrosion of Clad Metals," *Metals Handbook*, 9th Ed. vol. 13, ASM International, pp. 887–890.

R. Carson, "Cladding, " *McGraw–Hill Encyclopedia of Science & Technology*, 8th Ed. pp. 737–739.

Clad Metal Specialties Brochure, "Technology and Craftsmanship Come Together".

Composition of copper alloys commercially available (no title or date).

* cited by examiner

FIG. 14.
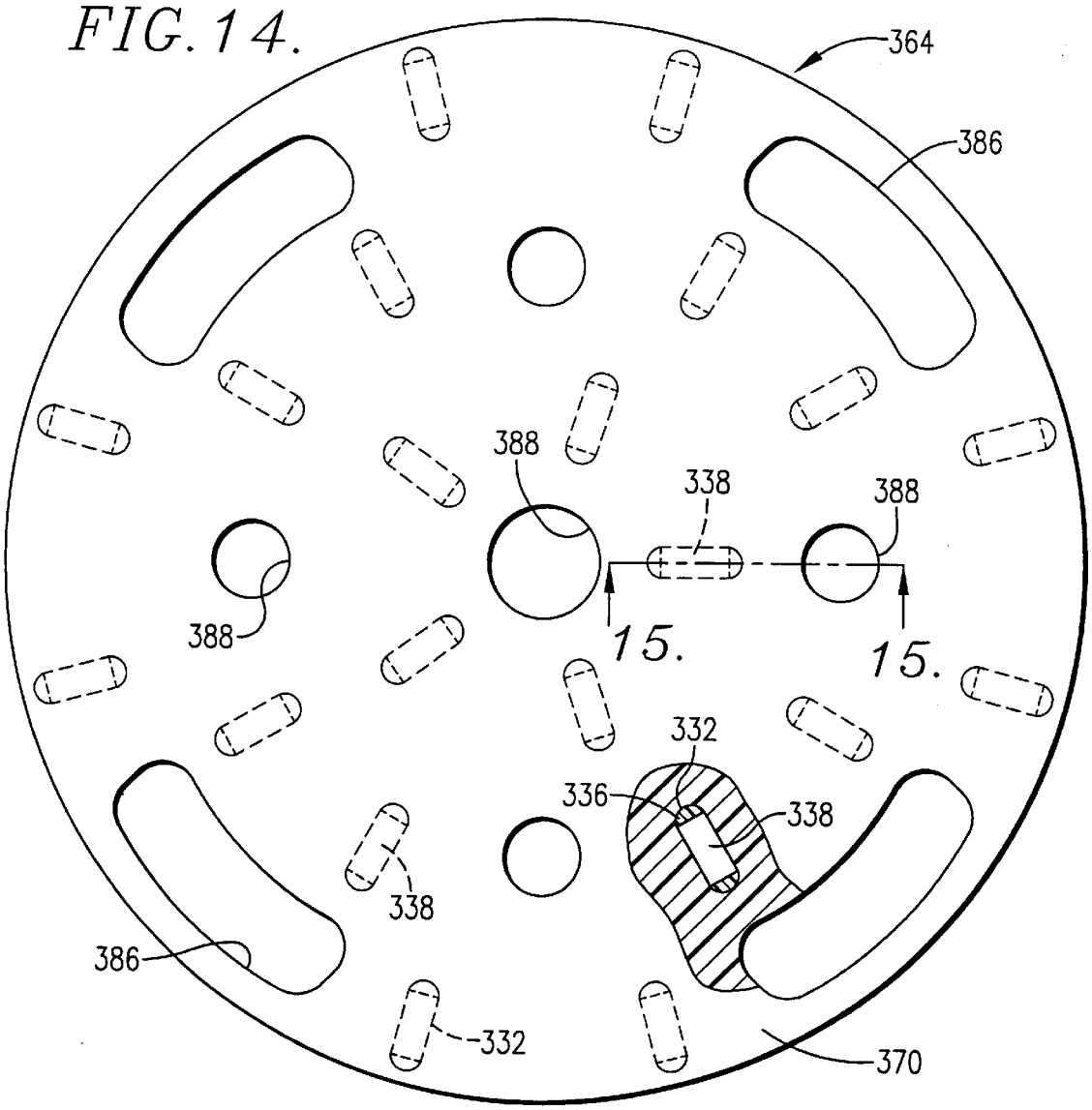
FIG. 15.
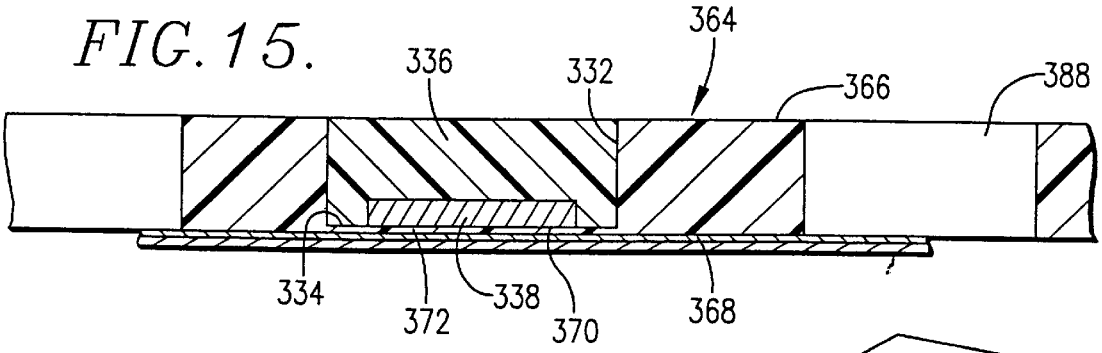
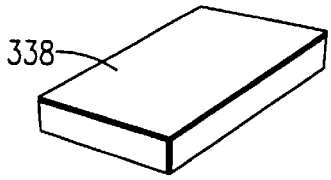
FIG. 16.

NON-FERROUS/FERROMATIC LAMINATED GRAPHIC ARTS IMPRESSION DIES AND METHOD OF PRODUCING SAME

RELATED APPLICATION

This is a continuation-in-part of U.S. application Ser. No. 09/392,179 filed Sep. 9, 1999, and entitled NON-FERROUS/STEEL LAMINATED GRAPHIC ARTS DIES AND METHOD OF PRODUCING SAME.

BACKGROUND OF THE INVENTION

1. Field of the Invention

This invention relates generally to the field of graphic arts and especially to graphic arts impression dies such as copper, magnesium, bronze or other non-ferrous metal/ferromagnetic laminated dies. It also relates to graphic arts impression die assemblies for use on various types of stamping or embossing apparatus, including sheet or web-fed graphic arts presses such as clamshell, vertical or horizontal presses, and to improved processes for preparing the graphic arts impression dies and to preparation of impression graphic arts die assemblies. As used herein, the term graphic arts "impression die(s)" means at least the categories of graphic arts dies including hot foil stamping/blocking dies, embossing dies, debossing dies, embossing/debossing dies, combination/fluted/one-shot/foil embossing dies, and any other graphic arts dies which combine any one or more of these general types of die functions on a single plate for smooth, lenticular, textured or grained surfaces, or any other similar graphic arts metal, polymeric or composite impression dies.

More particularly, the invention concerns a cladded metal graphic arts impression die plate having a non-magnetic layer of metal integrally joined with a ferromagnetic layer of metal. A relieved, design-defining surface is provided in the outer face of the non-magnetic layer of metal. The graphic arts impression die plate is mounted on a magnetic support member and held in position thereon at least in part by a series of permanent magnets embedded in the magnetic support member in disposition to magnetically attract and hold the ferromagnetic layer of the graphic arts impression die plate supported by the magnetic support member.

The magnetic support member with the cladded metal graphic arts impression die plate thereon is adapted to be affixed to the chase of a stamping or embossing machine such as a sheet or web-fed graphic arts press, in disposition with the design-defining surface of the graphic arts impression die plate in alignment with a predetermined design location.

The utilization of a cladded metal sheet having a non-magnetic layer integral with a ferromagnetic layer for the graphic arts impression die plate facilitates formation of a relieved design in the outer surface of the non-magnetic layer, either by way of a chemical etching process, mechanically using a pantograph milling machine, a computer numerically-controlled (CNC) laser or mechanical milling machine or an operator-controlled milling machine, or by hand-engraving. The cladded metal sheet having a photo-resist coating on the outer surface of the non-magnetic layer of the sheet may be affixed to a magnetic support member through the medium of a series of permanent magnets on the magnetic support member which attract the ferromagnetic layer of the sheet. The magnetic support member and the cladded metal sheet thereon may then be positioned in an etching machine for etching of the exposed areas of the non-magnetic layer of the cladded metal sheet which are not protected by the photo-resist coating. The magnetic support member having embedded permanent magnets therein may also be used to support the cladded metal sheet blank in a chemical etching machine, CNC, pantograph, or operator-controlled milling machines, or during hand engraving, resulting in a design-defining surface. The magnets embedded in the magnetic support member are especially important in stabilizing the central area of the relatively thin cladded metal sheet blank while it is being machined.

2. Description of Related Arts

Stamping dies have long been used in the graphic arts field to apply thin metal foil or thin layers of other transferable material to a substrate such as paper, cardboard, thin metal films or plastic in accordance with a design formed in the stamping surface of the die. Similarly, embossing dies have been provided to emboss or deboss a desired design in a suitable substrate, and to produce lenticular lines, texturing or graining impressions in the paper, plastic, thin metal film or cardboard. Combination dies which combine hot foil stamping or blocking, embossing or debossing, or formation of other surface feature designs are also well known in the art.

Graphic arts impression dies as described have long been prepared by etching or engraving a desired design in the outer surface of a metal plate, usually magnesium, copper or brass. These metal plates generally were of sufficient thickness, as for example about ¼ in., to cause the plate to be essentially self-sustaining. In the case of relatively long embossing or stamping runs involving as many as hundreds of thousands of impressions, it has been past practice to employ relatively long lived graphic arts impression die plates made of a metal such as copper or brass. For intermediate length runs, the plates were usually made out of magnesium which was less expensive and easier to engrave or etch a relieved design area than with copper or brass.

In those instances where the runs are shorter and any inherent wear of the die surface is acceptable from a final product quality standpoint, non-metal graphic arts impression dies have largely supplanted copper and brass, and even magnesium plates in more recent times by less costly and simpler non-metal dies. For example, steel-backed photo polymer graphic arts impression die plates have been developed in which a hardened photo polymeric composition representing the desired design is supported on a steel backing plate. These steel-backed photo polymer plates can be used with conventional foil stamping and embossing equipment.

Photo polymer graphic arts impression die plates are generally thinner than conventional magnesium, copper or brass graphic arts impression dies, and therefore a spacer plate has been required between the photo polymer graphic arts impression die plate and the chase of the stamping or embossing machine to avoid the necessity of modifying the embossing or stamping equipment.

Pat. No. 5,904,096 ("'096") of May 18, 1999, shows and illustrates one type of spacer plate that can be used to support a photo polymer graphic arts impression die plate on the chase of an embossing or stamping machine. The spacer plate of the '096 patent is provided with a series of permanent magnets which are described as being capable of magnetically attracting and holding the steel plate portion of the graphic arts impression die plate and thereby the photo polymer die assembly on the spacer plate. Use of a spacer plate of an appropriate thickness serves to support the photo polymer die in the required spaced relationship from the surface of the chase.

There is a need though for a graphic arts impression die which substantially has the longevity of conventional copper or brass dies, yet is less costly and easier to manufacture than conventional metal dies made of copper or brass. There has also been a need for decreasing the make-ready time involved in mounting of a hot foil stamping or blocking, embossing or debossing die on stamping or embossing equipment, particularly from the standpoint of proper alignment of the die with respect to the image onto which the foil is to be applied, or the image to be embossed or debossed. A further important need in the graphic arts impression die field is to provide a die which may be changed out and replaced in the stamping or embossing equipment or apparatus in a significantly shorter period of time than is presently the case.

SUMMARY OF THE INVENTION

An improved metal graphic arts impression die is provided which is made up of a cladded metal die plate having a design-defining non-magnetic metal layer such as copper, magnesium, bronze, or other non-ferrous metal which may be cladded to a ferromagnetic support layer that for example may be a steel sheet. A relieved area in the non-ferrous layer defines the design to be foil stamped, embossed, debossed or impressed. In a preferred form, the laminated metal graphic arts die plate has a layer of copper clad to a sheet of carbon steel.

In view of the fact that the laminated die plate is thinner than conventional one-piece magnesium, copper or bronze stamping dies or embossing dies, a die plate support is preferably provided for holding the laminated die plate on the chase of a foil stamping or embossing machine. An improved magnetic support plate is provided for the steel-backed, graphic arts impression die assembly made up of a non-ferrous support member having a die mounting surface which substantially complementally receives the cladded steel or steel-backed graphic arts impression die. A plurality of specifically spaced magnetic elements are embedded in the support member substantially through the full extent thereof. The attractive force of the steel backing to the magnetic surface of the support plate is enhanced by positioning of the magnets embedded in the support member such that adjacent pairs of the magnets have their north and south poles oriented oppositely, and a ferro-magnetic component is positioned in bridging relationship to each pair of magnets against the faces thereof opposite the die support face of the plate to enhance the magnetic flux emanating from each of the pairs of magnets.

The provision of a magnetic plate for supporting a steel-backed impression die has a major benefit in the use of the assembly in that minute adjustments in the position of the die on the support plate after mounting of the assembly on the chase of the sheet or web-fed press may be accomplished with greater facility and more rapidly than in past mounting practices wherein repositioning of the die could be accomplished only by time-consuming manipulation of a number of fastening devices.

In a preferred embodiment of the invention, the magnets are of square shape, with each pair of magnets being in specifically spaced relationship from one another, and from adjacent pairs of magnets. The magnets of each pair are positioned such that their north and south pole axes extend through the major faces of each of the magnets, with the length and width dimensions of each of the magnets being substantially greater than the thickness of each magnet. The ferro-magnetic component is preferably in the nature of a steel plate that extends between and engages the major face of each of the magnets which is most remote from the die mounting surface of the support member.

The steel strip which extends between and engages the major face of each of the magnets most remote from the die mounting surface of the support member, enhances the holding power of the bridged magnets by directing and concentrating the magnetic field surrounding those ends of the magnets in closest proximity to the die assembly supporting surface of the support member. The ferro-magnetic component also functions to decrease the flux leakage from the magnets at the perimeter of the magnetic field created by respective pairs of magnets.

The individual magnets are embedded in the non-ferrous support member in positions causing the major faces thereof in closest proximity to the die mounting surface of the support member to be spaced inwardly from the plane of the outer die mounting surface. The magnets are not however spaced so far from the die mounting surface to significantly decrease the magnetic attractive flux of the magnets or the die assembly. In this way, the magnets are protected against wear or breakage during the frequent attachment to and detachment of the magnetic support plate graphic arts die assemblies from the magnetic support member. Furthermore, a smooth and consistent outer die support surface is presented that is not interrupted by the outer surface of the magnets to thus minimize any distortion of the design-defining layer.

The magnetic support member of this invention is also useful to support a cladded steel or steel-backed graphic arts impression die made up of a non-ferrous, design-defining layer backed by steel during removal of material from the surface of the non-ferrous layer by etching to form the design image in the outer surface thereof. Where the design-defining image is produced by a chemical etching process, a photo-resist composition is first applied to the outer surface of the non-ferrous layer of the cladded metal sheet. The photo-resist composition is configured to define the portion of the non-ferrous layer which is not to be removed by an etchant solution in the etchant bath equipment.

A magnetic die support plate for the graphic arts support die is preferably fabricated of plastic or other etchant-resistant material and is provided with a series of pairs of permanent magnets embedded therein as described and in disposition to magnetically attract the steel layer of the cladded metal sheet to at least partially hold the cladded metal die on the die plate support. The assembly of the cladded metal die plate with the photo-resist composition on the outer face of the non-ferrous layer of the die plate, and the support for the die plate may then be placed in an etchant machine to effect etching of a desired design in the outer surface of the non-ferrous layer.

Upon completion of the etching step and removal of the photo-resist composition from the surface of the non-ferrous layer of the cladded metal die plate, the die plate is ready for attachment to the spacer plate and then to the chase of the embossing or stamping machine.

BRIEF DESCRIPTION OF THE DRAWINGS

FIG. 14 is a plan view of a fourth form of movable support structure for supporting the graphic arts impression die plate during etching or milling thereof;

FIG. 15 is a fragmentary, cross-sectional view taken along line 15—15 of FIG. 14, looking in the direction of the arrows, and further illustrating a graphic arts impression die plate against one face of the support structure; and FIG. 16 is a perspective view of one of permanent magnets embedded in the support structure of FIGS. 14 and 15.

DETAILED DESCRIPTION OF THE PREFERRED EMBODIMENTS

Graphic Arts Impression Die Plate

Figure 1:
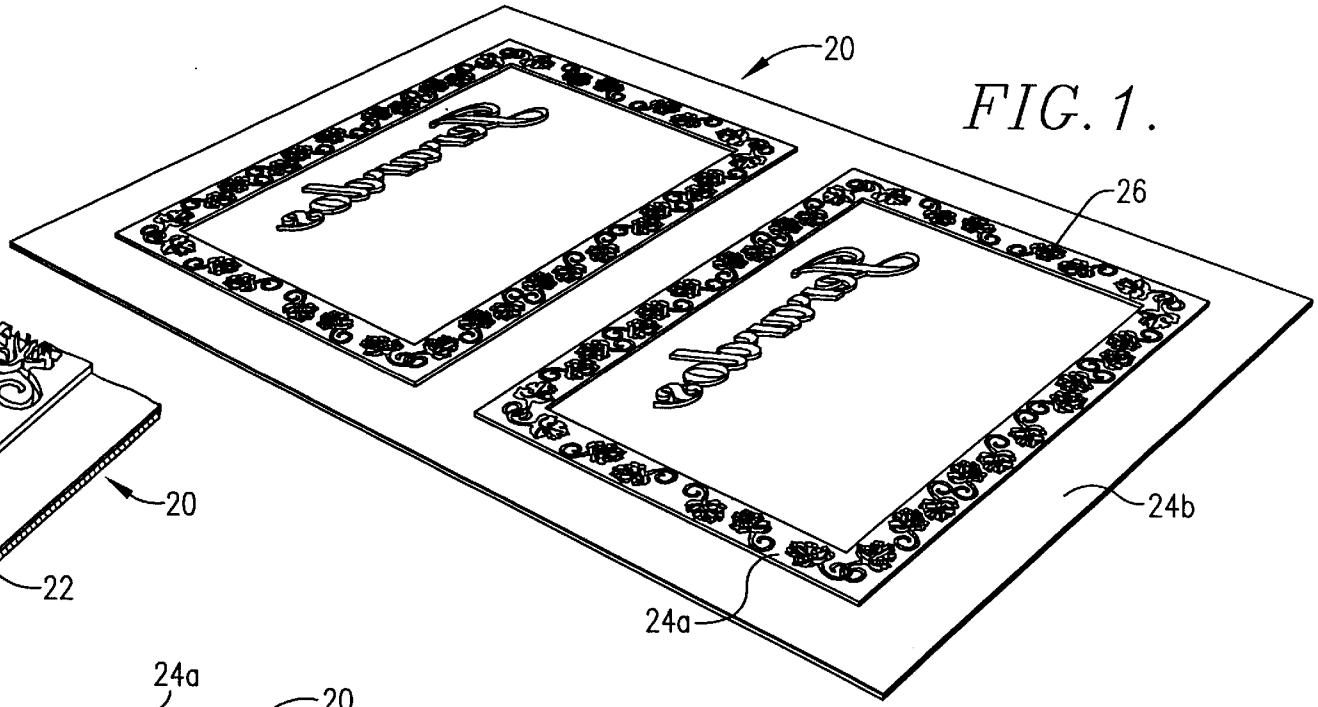
FIG. 1 is a perspective view of a graphic arts metal impression graphic arts impression die plate constructed in accordance with the preferred embodiment of this invention.

A metal laminated graphic arts impression graphic arts impression die plate constructed in accordance with the preferred concepts of the present invention is broadly designated by the numeral 20 in FIGS. 1–4 of the drawings. The graphic arts impression die plate 20 may be of a type including a hot foil stamping or blocking die, an embossing die, a debossing die, a lenticular line die, a texturing die, a graining die, combinations of any of these die designs on a single graphic arts impression die plate, or other similar graphic arts metal impression dies (herein collectively referred to as "graphic arts impression dies").

The blank for preparation of graphic arts impression die plate 20 is preferably a cladded metal plate made up of a steel sheet or layer 22, and a non-ferrous sheet or layer 24 which is integral throughout the extent thereof with layer 22. Utilization of a cladded metal plate for preparation of a graphic arts impression die having a ferromagnetic base layer while the layer of material that is cladded to the base layer is a non-ferrous metal, allows advantage to be taken of the ability of the cladded plate to be attracted to and held in place in a desired location by support structure which includes a plurality of permanent magnets.

Accordingly, a cladded graphic arts impression die plate blank which is useful in the present invention has a ferromagnetic base layer, although the non-ferrous metal layer cladded to the base layer may be of various materials, such as copper, bronze, magnesium and similar metals which are amenable to etching by a suitable etchant solution, or can be mechanically machined to produce the required design-defining image in the surface of the non-ferrous layer of the plate. Copper is a metal of choice for the non-ferrous layer of the cladded metal graphic arts impression die plate in that it can readily be etched in with a ferric chloride solution, and especially a ferric chloride solution containing an additive for controlling the degree and rate of the etching process. Magnesium is another non-ferrous material that may be cladded to the steel base layer, in that the magnesium may be etched in a conventional manner with a nitric acid solution of well known composition in the engraving die field. Bronze on the other hand, is a metal of choice for the non-ferrous layer of the cladded metal graphic arts impression die plate in instances where the design image in the outer surface of the non-ferrous layer is formed by a pantograph milling machine, a CNC laser or mechanical milling machine, or an operator-controlled milling machine, or by hand-engraving.

In the cladding process, which may be carried out in a manner that has long been conventional in the cladding industry, a strip of non-ferrous metal is brought into surface engagement with a strip of ferromagnetic material such as steel and the two layers in proximal relationship are fed between one or more compression rollers which apply extremely high surface pressures on opposite sides of the non-ferrous metal and steel sheets. In order to assure integration of the non-ferrous metal sheet with the steel sheet, as depicted schematically in FIGS. 2 and 3, the pressure applied to the interengaging non-ferrous metal and steel sheets should be sufficient to assure complete cladding of the non-ferrous metal to the steel layer.

A preferred cladded copper and steel die blank is manufactured by applying sufficient pressure to the interengaging copper and steel sheets which is sufficient to cross-sectionally deform the copper at least about 50% under cold welding conditions. If the copper and steel cladding process is carried out at an elevated temperature, as for example from about 800° C. to about 1100° C., then required integration of the interengaging surfaces of the copper and carbon steel may be accomplished at somewhat less pressure and in shorter time. The copper and carbon steel cladded product may be annealed at a temperature of about 480° C. if desired to increase the flexibility of the product.

In the case of a cladded metal graphic arts impression die plate 20 of steel and copper, the copper layer is desirably of from about 0.020 in. (0.508 mm) to about 0.090 in. (2.286 mm) in thickness, and the steel layer is from about 0.008 in. (0.0203 mm) to about 0.20 in. (5.080 mm) in thickness. The preferred copper/ferromagnetic cladded graphic arts impression die plate blank has a steel layer which is nominally 0.030 in. (1.076 mm) in thickness and a copper layer which is nominally 0.040 in. (1.016 mm) thick. A blank of that total thickness presents a relatively rigid structure, and is therefore useful in flat bed applications. However, if a somewhat flexible final die is preferred, allowing the die to be formed into a semi-circular configuration for mounting on the cylinder of a rotary press, a cladded metal blank having a steel layer of nominally about 0.008 in. (0.0203 mm) thick and a copper layer of nominally about 0.020 in. (0.508 mm) thick is preferred.

In those instances where the total thickness of the copper/ferromagnetic blank cladded plate is less than about 0.060 in. (1.524 mm) thick, it is desirable that the cladded metal die blank be annealed for approximately 1 hour at about 480° C. to about 650° C. and then air-cooled. Annealing serves to make the grain of the copper more uniform. At cladded blank thicknesses exceeding about 0.060 in. (1.524 mm), annealing is not usually required.

In the preferred embodiment, the steel layer of the copper/ferromagnetic cladded die blank is type 1008 carbon steel of conventional specifications, while the copper layer is desirably type C10700 copper sheet having a melting point of about 1083° C., a density of about 0.323 lbs/cu. in. at 20° C., a co-efficient of thermal expansion of from about 0.0000170 to about 0.0000177 per ° C. from 20° C. to 300° C., a modulus of elasticity of about 17,000 ksi, a modulus of rigidity of about 6400 ksi, and a thermal conductivity value of about 224 btu per ° F. from 68° F. to about 572° F. The copper should be substantially oxygen and lead-free, contain minimal zinc, and typically includes about 0.85% wt of silver. Other useful copper/ferromagnetic cladded metal die blanks may be employed where the layer of copper meets standard copper alloy specifications C10200–C11600 inclusive, and particularly copper alloy specification Nos. C10200, C10300, C10400, C10500, C10700, C10800, C11100, C11300, C11400, C11500, and C11600. The bronze layer of a bronze/ferromagnetic cladded metal die blank preferably meets standard copper alloy specification No. C22000, for commercial bronze 90%.

Figure 2:
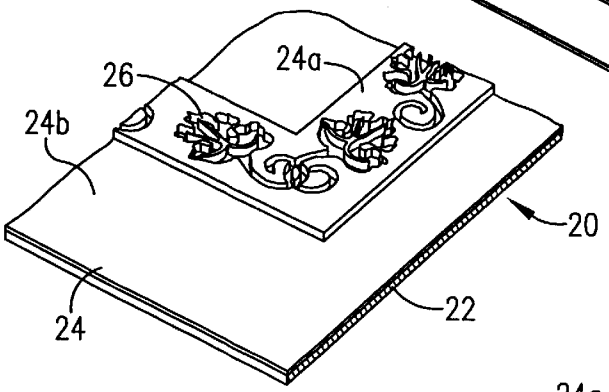
FIG. 2 is a fragmentary perspective view of one corner of the die illustrated in FIG. 1, to better illustrate the configuration of the die structure.
Figure 3:
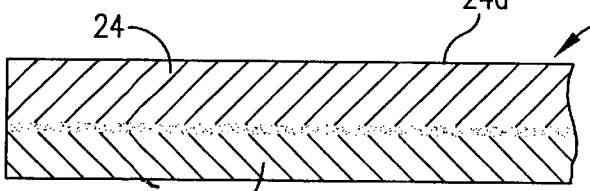
FIG. 3 is a fragmentary, enlarged, essentially schematic view of the corner of the die as depicted in FIG. 2, with the entire original outer surface of the graphic arts impression die plate having been removed by an etching process.
Figure 4:
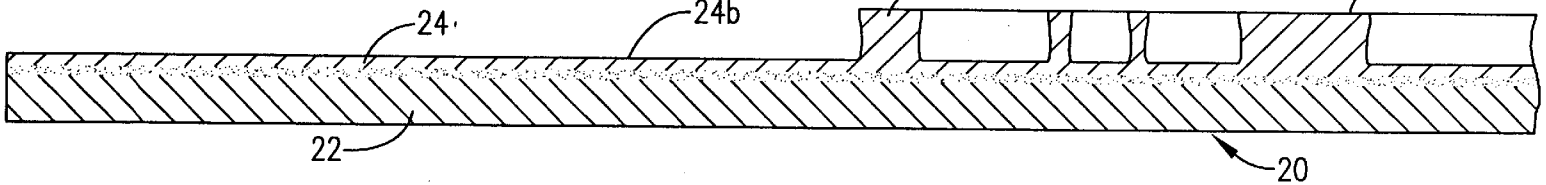
FIG. 4 is a fragmentary, enlarged, essentially schematic view of a larger segment of the die as shown in FIG. 1 and depicting areas of the die which have been removed by etching or milling, as well as areas which have not been removed by an etching process or by milling.

The representative, relatively rigid copper/ferromagnetic cladded graphic arts impression die plate 20 as for example shown in FIGS. 1–4 may be prepared from a cladded metal blank having a nominal total thickness of about 0.070 in. (1.778 mm). In this exemplary cladded graphic arts impression die plate, the carbon steel layer 22 has a nominal thickness of about 0.015 in. (0.0381 mm), while the copper layer 24 is about 0.055 in. (1.397 mm) throughout its extent prior to etching of the surface thereof. Part of the copper layer 24 is then removed by an etchant solution or mechanical milling to present a relieved design image 26, as depicted in FIGS. 1 and 2.

In order to effect controlled etching of the copper layer 24 of copper/ferromagnetic graphic arts impression die plate 20 to produce the design image 26 for a graphic arts impression die, an image is placed on the outer surface 24*a* of copper layer 24 which is a negative of the desired design image 26. The surface 24*a* is then spray-coated with an ultra-violet light-sensitive, positive or negative-working, photo-resist composition. The positive resist solution may consist of a photo-active compound including a mixture of diazonapthoquinone, phenolic resins, surfactants, plasticizers, and 1-methoxy-2-propanol. A negative photo-resist may be a mixture of a photosensitive polymer such as a methacrylate with an initiator, surfactant and/or plasticizers. The solid content of the resist is normally about 12%. A film mask is placed over the coated surface 24*a* of copper layer 24 and held closely by means of a vacuum system. The plate is exposed to UV light for a sufficient period of time to change the properties of the photo-resist, depending upon the photo-resist being used. Development of the coated plate by washing with a dilute alkaline solution such as sodium metasilicate removes the exposed area.

The coated plate with the photo-resist coating on surface 24*a* of layer 24 is then preferably etched with a ferric chloride solution having a ferric chloride concentration ranging from about 25 to about 40 Bé, and nominally about 30 Bé $FeCl_3$ solution.

A preferred etching machine is illustrated and described in U.S. Pat. No. 5,364,494 ("'494 patent"), owned by the assignee hereof and which is specifically incorporated herein by reference thereto. The etchant solution in the etching machine is normally maintained at a temperature of about 21° C.–25° C. The cladded metal graphic arts impression die plate 20 with the developed photo-resist design image thereon is clamped to the rotatable turntable of the etching machine shown in the '494 patent and the turntable is rotated at about 3–5 rpms. The flow of the etchant into the etching machine is maintained at about 45–57 1/min. The paddles in the etching machine of the '494 patent, rotated at about 500–650 rpm, cause the etching solution to be splashed against the surface 24*a* of the cladded metal graphic arts impression die plate 20. The depth of etch is a function of the etch rate of about 0.001 in./min (0.0254 mm/min). Therefore, a depth of 0.010 in. (0.254 mm) requires about 10 minutes of etching time.

The reaction of ferric chloride with copper metal ($Cu^{\circ}+2FeCl_3 \rightarrow CuCl_2+2FeCl_2$) is an isotropic process and therefore occurs uniformly in all directions. Thus, as metal is removed and a relief is formed in the surface 24*a* of plate 24, lateral etching can occur, usually termed "undercutting." To minimize undercutting and form a beveled surface at a desired angle, protectant and stabilizing additives may be incorporated in the etching solution.

As ferric chloride reacts with the copper metal, cuprous ions react (chelate) with the additives to form a film on the surface of the copper metal. The extent of film forming is related to the concentration of the additives. Foramidine disulfide dihydrochloride and the ethylenethiourea are the key additives for maintaining a desired bevel angle. These additives are added to the etchant in varying amounts, depending on the reading from a given test target. The proper balance of the ferric chloride content, protective agent and elemental copper in the etching solution is adjusted based on the results of immersing a copper test target in the etch solution for 5 minutes. This test target contains a scale of a series of half-tone images maintained at certain percentages and also contains various other lines and images. After removal from the solution, an experienced operator visually interprets the test target to determine, based on experience, whether more additive or additional ferric chloride should be added to the solution, or whether the copper content has reached a level that dictates preparation and use of etchant solution. Those skilled in the art appreciate that this interpretation is subjective, depends on certain variables, and is carried out most effectively by an operator that has had requisite training and experience, and therefore has the necessary skill to use the test target results as a guide to determine the protective behavior of the etching solution.

Where the copper layer 24 of the graphic arts impression die is to have a nominal thickness of about 0.055 in. (1.397 mm), the die may for example be subjected to the etching operation for a period of time and under conditions to remove unprotected areas of the copper to a depth of about 0.030 in. (0.762 mm), leaving about 0.025 in. (0.635 mm) of the initial copper layer remaining. Thus, in FIG. 4, the height of the design image 26 in the representative example, is approximately 0.030 in. (0.762 mm), the remaining copper layer 24*b* defining the design image 26 is about 0.025 in. (0.635 mm), while the steel layer 22 is about 0.015 in. (0.381 mm). Upon removal of the photo-resist from the outer surface of the design image 26, the graphic arts impression die plate 20 is ready for use in stamping, embossing or debossing operations.

Although cladded metal graphic arts impression die plate 20 is shown in FIGS. 1–4 as being of planar configuration, it is to be understood that the graphic arts impression die plate is sufficiently flexible that it can be bowed to an extent as required to complementally fit on the rotary cylinder of a stamping, embossing or debossing press. In this instance, therefore, the graphic arts impression die plate will in use be of semi-circular configuration. The design-defining relieved image in the copper surface 24 of the graphic arts impression die plate 20 may be configured to accommodate the intended bowing of the graphic arts impression die plate 20 for use, as may be necessary, and as is well understood in the graphic arts field. However, a preferred graphic arts impression die for rotary press use has a ferromagnetic layer 22 of steel about 0.008 in. (0.203 mm) and a total non-ferrous layer 24 of about 0.020 in. (0.508 mm). In this case, the non-ferrous layer is desirably etched to a depth of from about 0.002 in. (0.050 mm) to about 0.020 in. (0.508 mm).

Graphic Arts Impression Die Assembly

One specially useful application of a graphic arts impression die plate 20 as described above is in a clamshell-type hot foil stamping or blocking die press having a stationary heated chase and a movable pressure plate. This equipment is constructed for mounting of a conventional magnesium, copper or brass die on the heated chase, with metal foil being moved into position over the die, a paper sheet or other media onto which the foil is to be applied is interposed between the foil and the pressure plate, and then the plate is rotated through an arc to apply pressure against the paper and foil pressed against the die. The resulting pressure and heat from the die causes foil conforming to the configuration of the design in the die to be transferred to the surface of the paper or other substrate. Rigid magnesium, copper or brass dies designed for this type of application are conventionally about 0.25 in. (6.35 mm) in thickness in the case of the "Americas" (North, Central and South America) and about 7 mm (0.276 in.) for the "rest of the world" (ROW).

In order to use the graphic arts impression cladded metal graphic arts impression die plate 20 in a conventional stamping machine such as a clamshell press, a backing member for the plate 20 may be necessary in view of the fact that the graphic arts impression die plate is of less thickness than conventional rigid magnesium, brass or copper graphic arts impression plates. The backing member though, must be capable of transferring adequate heat from the heated chase of the clamshell press to the design image-defining copper layer 24 of graphic arts impression die plate 20. Steel is desirably used for the layer 22 of cladded graphic arts impression die plate 20 not only because of its high strength to weight ratio, but also because of its ferromagnetic properties.

Figure 12:
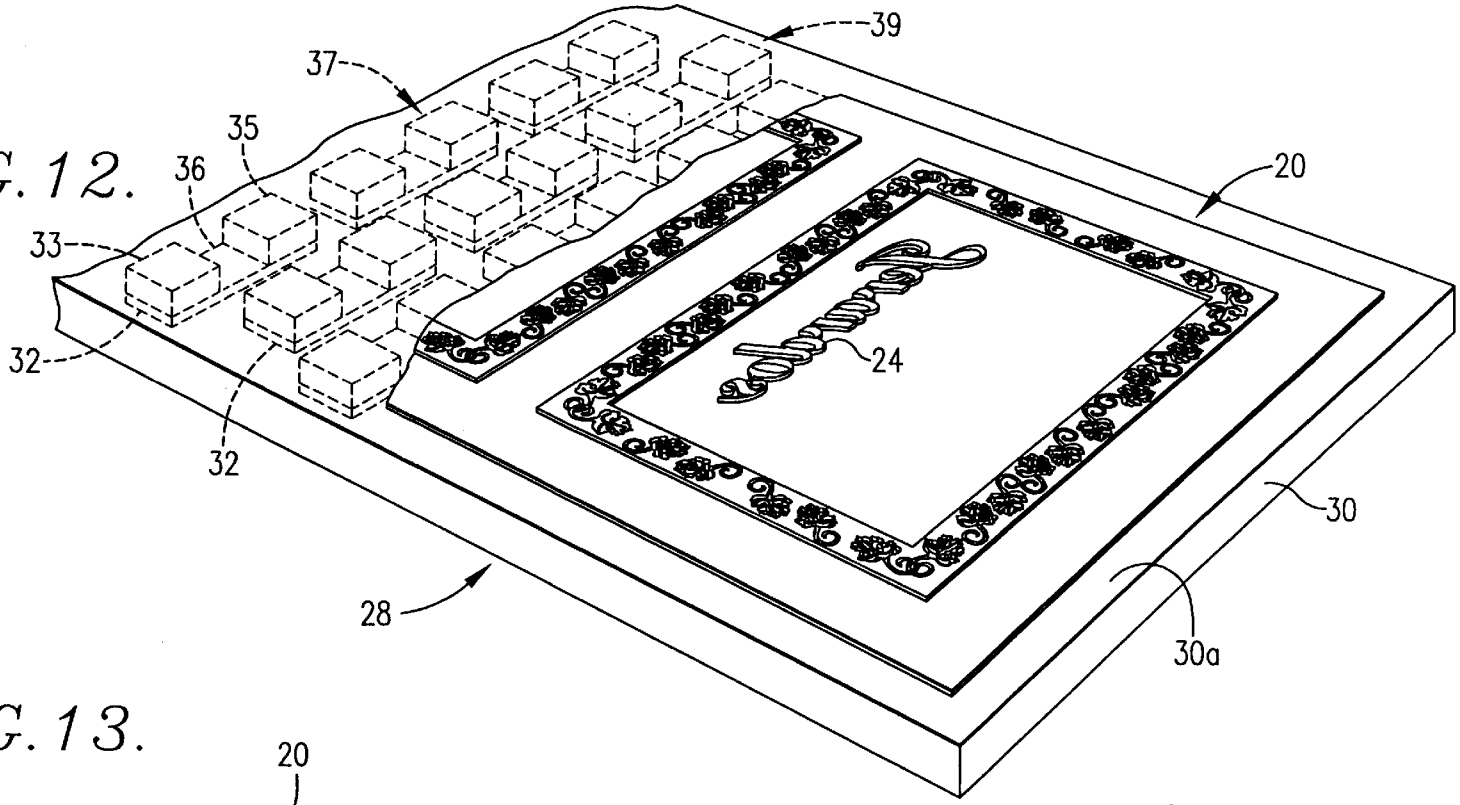
FIG. 12 is a fragmentary perspective view of a stamping die assembly which includes a graphic arts metal impression graphic arts impression die plate positioned on a magnetic support member and held in place thereon by a series of spaced pairs of magnetically-enhanced magnets embedded in the magnetic support member.
Figure 13:
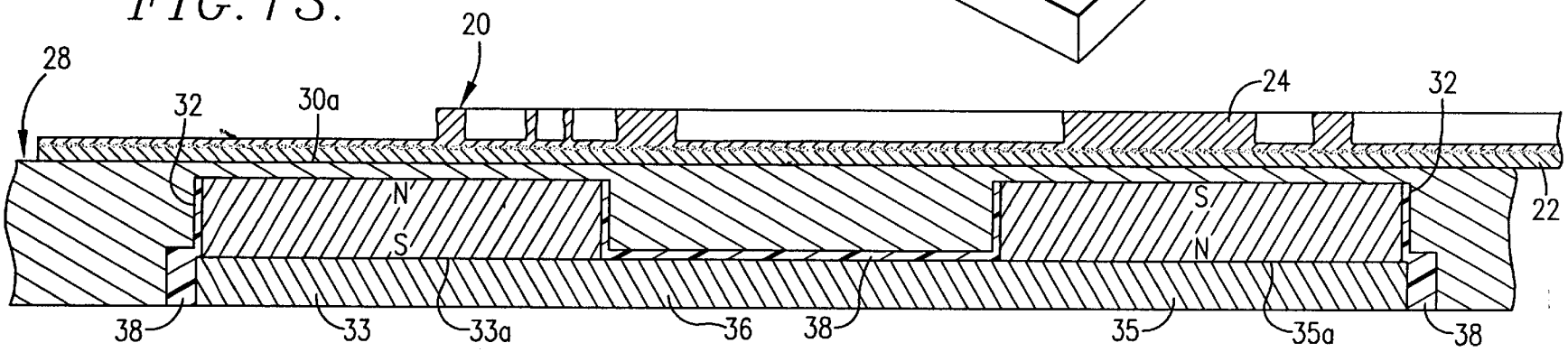
FIG. 13 is a fragmentary, essentially schematic vertical cross-sectional view through a portion of the assembly as shown in FIG. 12.

A preferred magnetic support or backing member 28 for cladded metal graphic arts impression die plate 20 is illustrated in FIGS. 12 and 13 of the drawings. The backing or magnetic support member 28 preferably comprises a flat, relatively rigid, non-ferrous metal or plastic plate 30 of width and length dimensions greater than the graphic arts impression die plate 20 that is to be mounted thereon, so as to provide complete support for the graphic arts impression die plate 20 throughout the width and length thereof. The magnetic support member 28 is preferably fabricated of a plastic or etchant-resistant material such as PVC, an acrylic resin, nylon, a polycarbonate polymer, a glass fiber reinforced epoxy composition, a plastic composite reinforced with carbon fibers, tempered glass, titanium, or a ceramic material. Plate 30 should be of a thickness such that when a graphic arts impression die plate 20 is mounted thereon as illustrated in FIGS. 12 and 13, the combined thickness dimension of plate 30 and graphic arts impression die plate 20 is approximately equal to the thickness of a conventional magnesium, copper or brass hot foil stamping or blocking die, or about 0.25 in. (6.35 mm) for the Americas and about 7 mm (0.276 in.) for the ROW.

Alternately, the die assembly may comprise a layer of polymeric material presenting the design image which is applied to and firmly affixed to a ferro-magnetic sheet such as steel backing sheet 22. The polymeric material is preferably a thermoset resin selected from the group consisting of allyl polymers, epoxy polymers, furan, melamine formaldahyde, melamine phenolic polymers, phenolic polymers, polybutyldiene polymers, thermoset polyester and alkyd polymers, thermoset polyimide polymers, thermoset polyurethane polymers, flexible thermoset silicone polymers, silicone epoxy polymers, and thermoset urea polymers, all of which have properties and characteristics permitting their utilization in a well known manner to prepare what is conventionally known in the graphic arts field as a polymeric die.

Magnetic support member 28 preferably comprises a relatively rigid, non-ferrous metal plate 30 (or of non-heat conductive materials such as plastic or wood for non-heat applications) of width and length dimensions greater than the die plate 20, or a steel-backed polymeric die plate assembly that is to be mounted thereon, so as to provide complete support for the die plate assembly throughout the width and length thereof. The support plate 30 is preferably fabricated of materials such as bronze, brass, copper alloys, aluminum alloys, magnesium alloys, nickel, zinc, titanium, wood, thermoplastic and thermoset synthetic resin compounds, synthetic resin composites comprising tempered glass fiber, metal fiber, carbon fiber or graphite fiber reinforced thermoset resins such as epoxies or bakelite, with copper alloy being a preferred material.

Plate 30 should be of a thickness such that when a die plate 20, or a steel-backed polymeric die assembly is mounted thereon, as illustrated in FIGS. 12 and 13, the combined thickness dimension of plate 30 and die plate 20 is approximately equal to the thickness of a conventional graphic arts impression die, i.e., about 0.250 in. (6.350 mm) for the Americas, and about 7 mm (0.276 in.) for ROW. Therefore, the thickness of the magnetic support member 28 should not exceed about 0.230 in. (5.842 mm) in the case of the Americas, and about 6.502 mm (0.256 in.) in the instance of ROW, taking into account the minimum thickness of a die plate of about 0.020 in. (0.508 mm).

In view of the fact that a cladded die plate such as die plate 20, or a polymeric die carried by steel backing, are both of less thickness than conventional rigid magnesium, steel, brass or copper graphic arts impression dies, the magnetic support member 28 of this invention functions to not only carry the die assembly, but also serves as a shim between the die plate and the chase of the press. In the case of a hot foil stamping press, the backing member must be capable of efficiently transferring adequate heat from the heated chase of the web or sheet-fed graphic arts press to the design image-defining copper layer 18 of die plate 20, or a polymeric die plate. Therefore, steel is desirably used for the layer 22 of die plate assembly 20, as well as for a polymeric die assembly, not only because of its heat retention properties and its high strength to weight ratio, but also because the steel is magnetically attracted to and held by the die mounting surface 30*a* of magnetic support member 28.

In the embodiment of the invention illustrated in FIG. 13, the plate 30 has a series of elongated, generally rectangular recesses or cavities 32 in the rear face thereof which may be formed for example by machining operations and that terminate in spaced relationship from the die plate mounting surface 30*a* of the plate. Each of the cavities 32 houses a pair of rectangular magnets 33 and 35 which are of a width and length substantially greater than the thickness thereof. The thickness of each of the magnetic elements is from at least about 0.040 in. (1.016 mm) to about 0.220 in. (5.588 mm) for the Americas, and about 0.246 in. (6.248 mm) for ROW. A preferred magnet may for example be of square configuration having dimensions of 0.5 in. (12.7 mm)×0.5 in. (12.7 mm) in width and length and 0.10 (2.54 mm) in. in thickness. In the preferred embodiments of the invention, the magnets 33 and 35 are spaced apart a distance of about 0.5 in. (12.7 mm). Magnets may be used that are from about 0.25 in. (6.35 mm)×0.25 in. (6.35 mm) to about 2 in. (50.8 mm)×2 in. (50.8 mm) with a spacing between adjacent magnets being about 0.10 in. (2.54 mm) for smaller magnets to about 3 in. (76.2 mm) for larger magnets within the specified magnets may be used. It is also to be understood in this respect that the cavities 32 should be spaced such that the distance between magnets in adjacent cavities are substantially within the ranges set forth for the magnets 33 and 35 in each cavity 32 and the spacing therebetween, depending upon the sizes of the magnets and the corresponding spacing between magnets 33 and 35 in each cavity 32. As is most evident in the embodiment shown in FIG. 12, the cavities 32 are arranged in aligned rows extending transversely of the plate 30. For example, as shown in FIG. 12, the cavities 32 of the row 37 thereof, are offset with respect to the cavities 32 of the next adjacent row 39. The offset positions of the cavities 32 repeats from row to row with the cavities 32 of adjacent rows being offset from one another. Thus, with respect to FIG. 12 for example, the spacing between adjacent rows 37 and 39 is preferably about 0.5 in. (12.7 mm) in the instance where the magnets 33 and 35 are 0.5 in. (12.7 mm)×0.5 in. (12.7 mm) and the spacing between such magnets is 0.5 in. (12.7 mm). Similarly, the spacing between cavities 32 in each row 37 and 39 should be about 0.5 in. (12.7 mm) in the exemplary embodiment.

A ferro-magnetic component 36 in the form of a steel strip is located within each of the cavities 32 in bridging, engaging relationship to the outer surfaces 33*a* and 35*a* respectively of magnets 33 and 35 which are remote from the die mounting surface 30*a* of plate 30. The ferro-magnetic component 36 may be steel, but vanadium-iron-nickel alloy (Permendor) is preferred because of its enhanced magnetic permeability, and is of a thickness of from about 0.010 in. (0.254 mm) to about 0.190 in. (4.826 mm) for the Americas and 0.216 in. (5.486 mm) for ROW. A preferred component has a thickness of about 0.060 in. (1.524 mm). The total thickness of each magnet 33 and 35 and the associated ferro-magnetic component 36 is at least about 0.050 in. (1.270 mm). A preferred thickness of magnetic support member 28 is about 0.180 in. (4.572 mm) for the Americas and 0.206 (5.232 mm) in ROW, with the distance between the die mounting surface 30*a* of member 30 and the adjacent upper surfaces of magnets 33 and 35 being about 0.020 in. (0.508 mm). An epoxy potting compound 38 serves to permanently affix the magnets 33 and 35 in respective cavities 32. The recommended operating temperature during use of the magnetic support member 28 is usually within the range of about ambient to 500 F.

The magnets 33 and 35 within each cavity 32 are positioned such that the north pole of magnet 33 for example is in closest proximity to the mounting surface 30*a* of plate 30 while the south pole of the magnet 35 is in adjacent relationship to the strip 36, as illustrated schematically in FIG. 2. As shown schematically in that same figure, the south pole of the magnet 35 is in closest proximity to the die assembly mounting surface 30*a* of plate 30, and the north pole of that magnet is adjacent strip 36. Thus, magnets 33 and 35 are mounted in each of the cavities 32 with opposite polarity.

The strength of magnets 33 and 35 is a function of the amount of magnetic flux available from a unit volume of the magnet material and the shape of the magnet, and is generally expressed in units of MGOe (Mega gauss orsted). The preferred magnet material for the present invention is selected from the group of samarium-cobalt (SmCo) having an MGOe of 16–32 and neodymium-iron-boron (NdFeB) having an MGOe of 24–48. Aluminum-nickel-cobalt (Alnico) having an MGOe of 2–8 can be used in certain instances provided the material is adequately engineered to produce a stronger magnet assembly. SmCo magnet material is most preferred because of its low temperature of remanence (Br), making it well suited for strong holding magnet assemblies operating at higher temperatures, as is the case with hot foil stamping/blocking dies.

Magnetic support member 28 serves to removably and releasably hold a graphic arts impression die thereon as depicted in FIGS. 12 and 13, wherein the steel layer 22 of die 20 for example rests against and is magnetically attracted to the die mounting surface 30*a* of plate 30 by magnets 33 and 35.

It is known that a magnetic circuit is the path which the magnetic flux from a magnet chooses to travel. Components in a magnetic circuit include the magnet, which acts as the source, along with air, other magnetic insulating material, and ferro-magnetic materials. All components other than the magnets act as impediments or reluctance to the flow of magnetic flux. The magnetic flux will choose to travel through the path that presents the least reluctance. Thus, reluctance in a magnetic circuit reduces the amount of magnetic flux from the magnet.

The magnetic attraction of a steel-backed die 20 to the magnetic support member 28 is significantly enhanced by the steel strips 36 bridging magnets 33 and 35 within each cavity 32 because of the significantly greater magnetic permeability of the steel as compared with air and the material from which plate 30 is fabricated.

Three dimensional boundary element method analyses have demonstrated that the magnetic holding force of two 32 MGOe 0.5×0.5×0.1 in SmCo magnets spaced 0.5 in. apart and in which the magnets 33 and 35 are bridged by a steel strip 36 confirms that the magnetic holding force is at least approximately three times greater than that of the holding force of a magnet arrangement wherein a steel strip bridging the two magnets is omitted. Furthermore, in the same test setup, the degree of leakage of magnetic flux from the arrangement in which a steel strip 36 between magnets 33 and 35 is provided is reduced by a factor of thirteen as compared with an arrangement in which the bridging steel strip 36 is not provided.

Mounted within each of the segments 32*a* of the openings 32 and adhesively held in place therein is a permanent magnet element 38. Each of the magnetic elements 38 is of a size and located such that the upper surface 38*a* there of is generally parallel with face 34 of magnetic support member 28, and located with the outer surface thereof slightly below the plane of face 34. The number, relative spacing and directional orientation of the maximum magnetic field of each of the permanent magnets 38 are selected to assure that a graphic arts impression die plate 20 positioned thereon, as illustrated in FIG. 12, will hold the graphic arts impression die plate in the position where it is initially placed on the magnetic support member 28, unless deliberately shifted from that initial location. An advantage of the use of a number of permanent magnets 38 is the fact that even though graphic arts impression die plate 20 is not a sufficient thickness to be as rigid as a conventional magnesium, copper or brass stamping die, the magnetic attraction of the steel layer 22 of graphic arts impression die plate 20 to the magnets 38, causes the graphic arts impression die plate to lay in flat and uniform direct engagement against the face 34 of magnetic support member 28, throughout the extent of the graphic arts impression die plate 20.

Alternate magnetic support plate structure usable in this invention is illustrated and described in application Ser. No. 09/466,611 filed Dec. 17, 1999, entitled MAGNETIC SUPPORT PLATE FOR CLADDED STEEL AND STEEL-BACKED POLYMER STAMPING/BLOCK AND EMBOSSING GRAPHIC ARTS DIES, and assigned to the assignee herein, which is specifically incorporated herein by reference thereto.

Although not specifically illustrated in FIGS. 12 and 13, it is to be understood that if more secure attachment of graphic arts impression die plate 20 to magnetic support member 28 is desired than afforded by the multiplicity of the magnets 33 and 35 within respective cavities 32, that fixation may be accomplished by providing a series of adjustable clamps carried by magnetic support member 28 at strategic locations to engage opposed edges of the graphic arts impression die plate 20.

Alternatively, pin structure may be employed to prevent lateral movement of the graphic arts impression die plate 20, especially in those instances where the relieved design-defining image to be formed in the layer 24 of the graphic arts impression die plate 20 using a milling machine, or hand-manipulated tools. A series of holes may be provided in the magnetic support member 28 for selective receipt of individual pins engageable with corresponding edges of the graphic arts impression die plate 20. Desirably, the graphic arts impression die plate holding pins are positioned on all sides of the graphic arts impression die plate 20, with two spaced holding pins on each side of the graphic arts impression die plate being provided.

The assembly of cladded metal graphic arts impression die plate 20 and backing or magnetic support member 28 as shown in FIGS. 12 and 13 may be mounted on the heated chase of a conventional clamshell hot foil stamping or blocking die press in the same manner as a conventional rigid magnesium, copper or brass die. As is well known to those skilled in this art, the heated chase of a conventional clamshell hot foil press is of so-called honeycombed design having a large number of openings for receipt of adjustable clamps for securing the die to the chase. In this manner, die may be located in a desired position relative to the overall extent of the chase.

Even though a chase is conventionally provided with a relatively large number of clamp-receiving openings, there are instances where it is desirable to further adjust the position of the die relative to the substrate to be impressed, and such desired die movement cannot always be accommodated because of the fixed relative positions of the clamp-mounting holes in the chase.

With the present assembly, however, magnetic affixation of the graphic arts impression die plate 20 to the backing or magnetic support member 28 allows the user to adjust the position of the graphic arts impression die plate on the magnetic support member in even minute amounts if desired, after the assembly of the support or backing member 28 and graphic arts impression die plate 20 have been attached to the chase. Make-ready time of a press can therefore be significantly reduced by virtue of the fact that it is not necessary to mount the die on the chase with the precision that has heretofore been required. Instead, the graphic arts impression die plate can readily be adjusted by simply relocating the graphic arts impression die plate 20 on the magnetic support member 28 within the overall dimensional limits of the latter after mounting of the magnetic support member 28.

The present invention therefore provides the operator of the stamping, embossing or debossing machine to more quickly make a press ready for final operation because of the ease with which the graphic arts impression die plate assembly may be correctly aligned with an image onto which foil is to be applied, or the image embossed or debossed. This enhanced and more efficient make-ready is attributable to the press operator's ability to make precise and very small adjustments if necessary in the position of the graphic arts impression die plate assembly on the chase of the press, without the heretofore required necessity of manipulating each of the clamps attached to the chase to permit trial and error repositioning of the graphic arts impression die plate.

Another important advantage of the graphics art impression die assembly comprising graphic arts impression die plate 20 and magnetic support member 28 is the decreased time required to change over from one graphic arts impression die plate to another. In the past, this has required manual unclamping of all of the clamps holding the graphic arts impression die plate on the chase of the press, removal of the graphic arts impression die plate, placement of another graphic arts impression die plate on the chase, and fixation of that graphic arts impression die plate to the chase by further manual locking of all of the clamps around the perimeter of the graphic arts impression die plate to respective edges of the die. Significant time and effort was required to effect this manual change-out of a die, especially because of the necessity of aligning the die with the image area to be embossed or stamped, frequently requiring unclamping and clamping of the die as minute adjustments are made in its position on the chase. That clamping and unclamping is largely eliminated by use of the present graphics art die assembly in that the magnetic support plate 28 may be secured to the chase of the press with conventional clamps in what amounts to a macro position, with the necessary adjustments in the graphic arts impression die plate position for precise alignment purposes requiring only shifting of the position of the graphic arts impression die plate 20 on the magnetic support member 28 to whatever degree is required, including very minute adjustment distances. Final positioning of the graphic arts impression die plate 20 on the magnetic support member 28 can therefore be accomplished without repeated clamping and unclamping of the graphic arts impression die plate itself as has been required in the past. The time necessary for die change-out in this respect has been substantially decreased, even in those instances where foil must be displaced in stamping operations, or embossing carried out on sample substrate having a design image thereon, to verify that the die is correctly positioned, or if not, how much the die must be shifted on the chase in order to obtain the necessary alignment with the image.

Method of Preparing Cladded Metal Graphic Arts Impression Die

Figure 11:
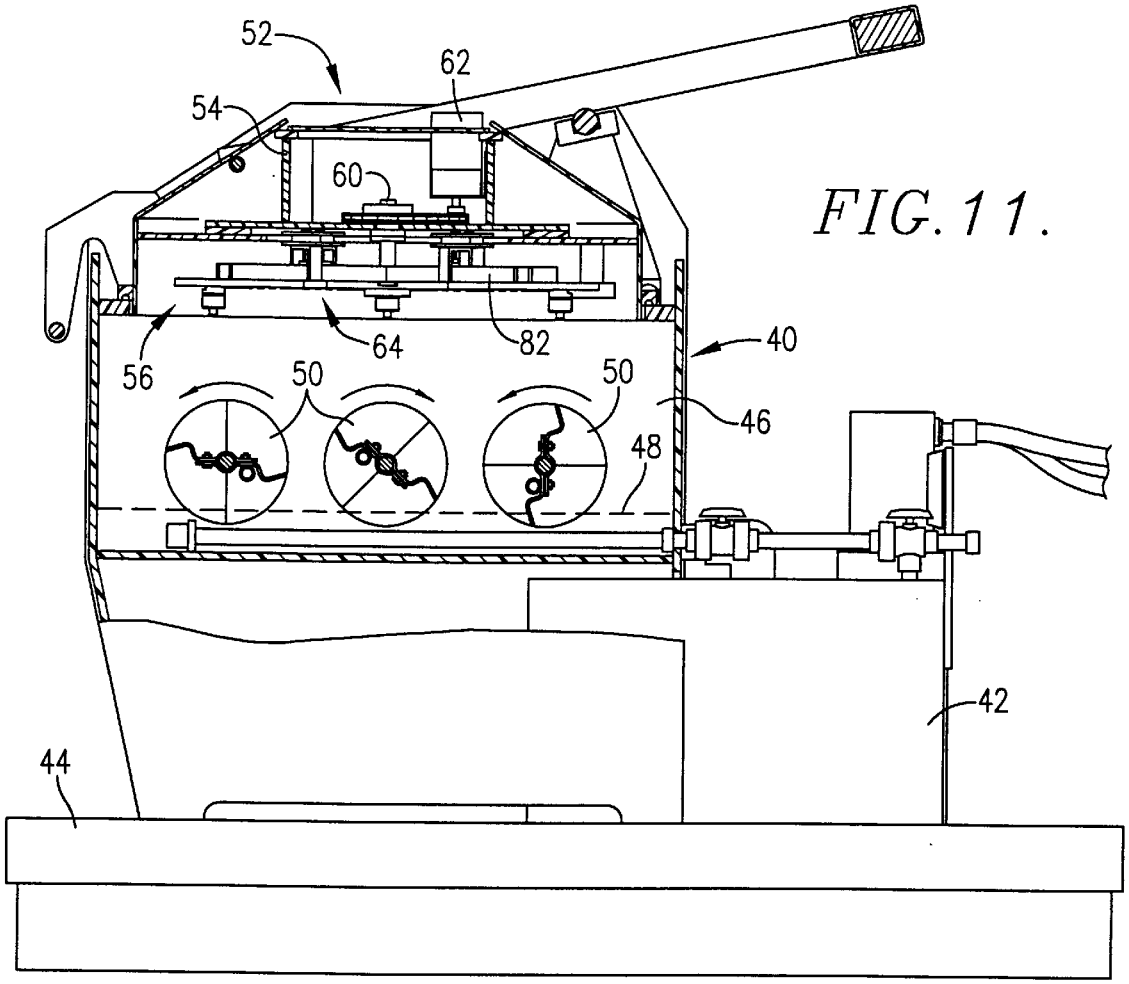
FIG. 11 is a side elevational view, partly in vertical cross-section, of etching apparatus usable to etch the graphic arts impression die plate while it is carried by a support structure as shown in FIGS. 7, 8 or 9.

FIG. 11 of the drawings illustrates etching apparatus as shown and described in the '494 patent, and which is useful for etching of graphic arts impression die plate 20 utilizing an etching composition and processing conditions previously described.

The etching apparatus 40 as depicted in FIG. 11 includes an etchant solution holding tank 42, a containment basin 44 in which the tank 42 is located, and an open-topped basin 46 defined by four upright side walls and a bottom wall. A shallow pool 48 of the etchant solution is maintained in the bottom of the basin 46 through the use of a weir. Three paddle wheel assembly units 50 serve to direct etchant solution upwardly against the overlying graphic arts impression die plate to be etched.

The pivotal hood assembly 52 overlying basin 46 normally closes the opened upper end thereof, but may be swung upwardly and backwardly to gain access to the interior of the basin 46 of the etching apparatus 40.

Hood assembly 52 has a depending frame assembly 54 which carries underlying, rotatable graphic arts impression die plate support structure broadly designated 56. The support structure 56 is rotated about a vertical axis through the medium of a shaft 60 connected thereto which is operably connected to and driven by an electric motor 62.

Figure 5:
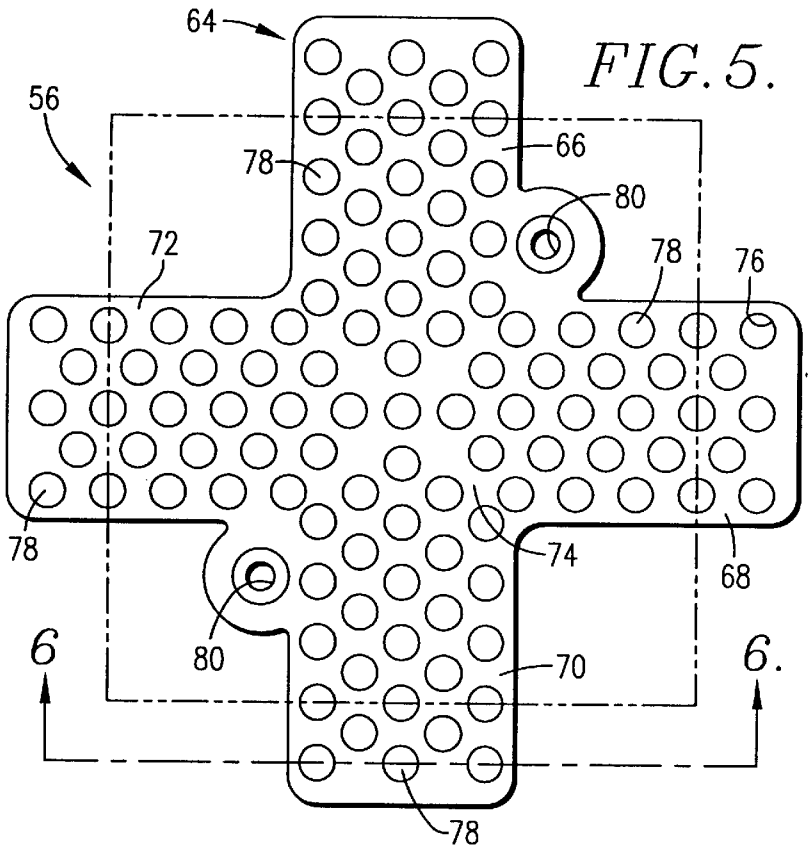
FIG. 5 is a plan view of one form of movable support structure for supporting the graphic arts impression die plate during etching thereof, and illustrating a series of individual, embedded permanent magnets for attaching the graphic arts impression die plate to the support structure.
Figure 6:
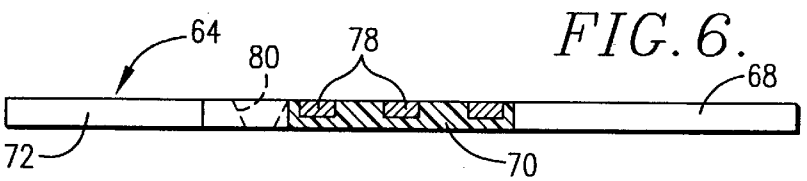
FIG. 6 is a horizontal cross-sectional view taken substantially on the line 6—6 of FIG. 5.

A preferred embodiment of support structure 56 comprises a plastic magnetic support member 64 of PVC shown in FIGS. 5 and 6. As is evident from these figures, magnetic support member 64 is of cross-shaped, planar configuration and has four legs 66, 68, 70, and 72 integral with a central section 74. The magnetic support member 64 has a plurality of openings 76 therein, each of which receives a respective magnet 78. Preferably two permanent magnets such as magnets 33 and 35 and an associated steel plate 36 in bridging relationship thereto as illustrated in FIG. 13 and described above, are mounted within each opening 76 of rectangular configuration and adhesively held in place therein. However, only one magnet 78 within a respective opening 76 as depicted in FIG. 1 has been found to provide satisfactory holding power in most instances for releasably securing a cladded metal die plate 20 on support structure 56 for etching purposes, noting in this respect that the displacement forces exerted on the cladded metal die plate 20 during etching attributable to rotation of the support 64 are not nearly as great or severe as the forces imposed on the die plate during mechanical milling or hand engraving thereof, or when the die plate is secured to a hot foil stamping or embossing chase of a graphic arts press. At least two diagonally-positioned mounting apertures 80 are provided in magnetic support member 64 to facilitate attachment thereof to a rotatable frame assembly 82 forming a part of rotatable support structure 56.

In use, a blank cladded metal graphic arts impression die plate 20 having a design-defining layer of photo-resist on the copper layer 24 is positioned on magnetic support member 64. The graphic arts impression die plate 20 is located such that the steel layer 22 engages the face 70 of the magnetic support member 64 whereby the magnetic attraction of layer 22 by magnets 78 causes the blank graphic arts impression die plate to be firmly affixed to magnetic support member 64. That magnetic support member normally will be pre-attached to the frame assembly 82 of the support structure 56 of the etching apparatus 40. Blank graphic arts impression die plate 20 is oriented with the copper layer 24 thereof facing outwardly away from magnetic support member 64. Thus, during operation of apparatus 40, the etching solution will impinge against the exposed surface of copper layer 24 to remove the copper to form the required relieved design-defining image.

Figure 7:
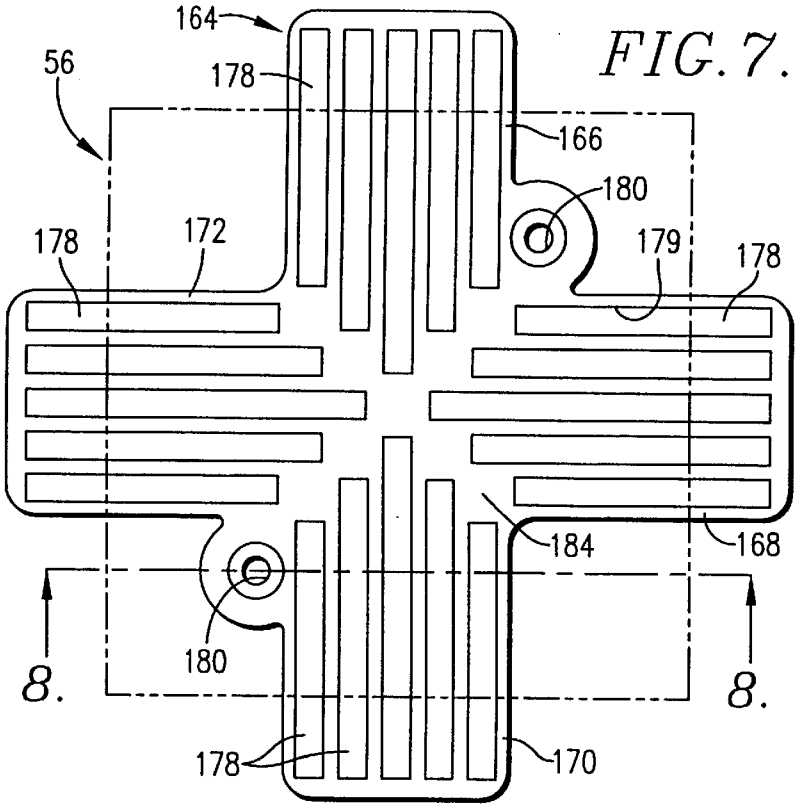
FIG. 7 is a plan view of a another form of movable support structure for supporting the graphic arts impression die plate during etching or milling thereof, and illustrating a series of strip-shaped embedded permanent magnets for attaching the graphic arts impression die plate to the support structure.
Figure 8:
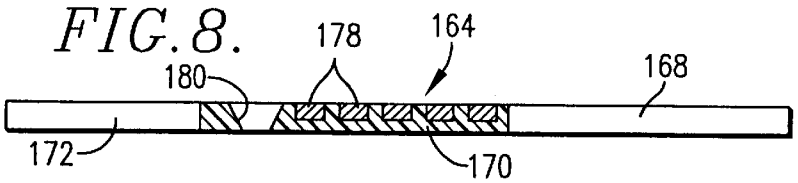
FIG. 8 is a horizontal cross-sectional view taken substantially on the line 8—8 of FIG. 7.

An alternate embodiment of structure for supporting the blank graphic arts impression die plate during etching thereof in apparatus 40 is shown in FIGS. 7 and 8. The support structure 164 as shown in these figures is of the same cross-shaped configuration and construction as magnetic support member 64 except that elongated, spaced strip-defining magnets 178 are substituted for the permanent magnets of magnetic support member 64. At least two apertures 180 are provided in magnetic support member 164 for attachment of the magnetic support member to frame assembly 82 of the etching apparatus 40.

Each of the magnets 178 is complementally received within a respective elongated, rectangular recess 179 in each of the legs 166–172, and held in place therein by suitable adhesive. The magnets 178 are preferably spaced a distance less than the width of each magnet 178 and oriented such that they extend longitudinally of a respective leg 166, 168, 170, and 172 of magnetic support member 164.

The magnetic support member 164 is used in the same manner as described with respect to magnetic support member 64, in that a blank graphic arts impression die plate placed thereon with the steel layer 22 in engagement with the face 184 of magnetic support member 164 is held in place by the magnetic attraction of steel layer 22 to strip magnets 178.

Figure 9:
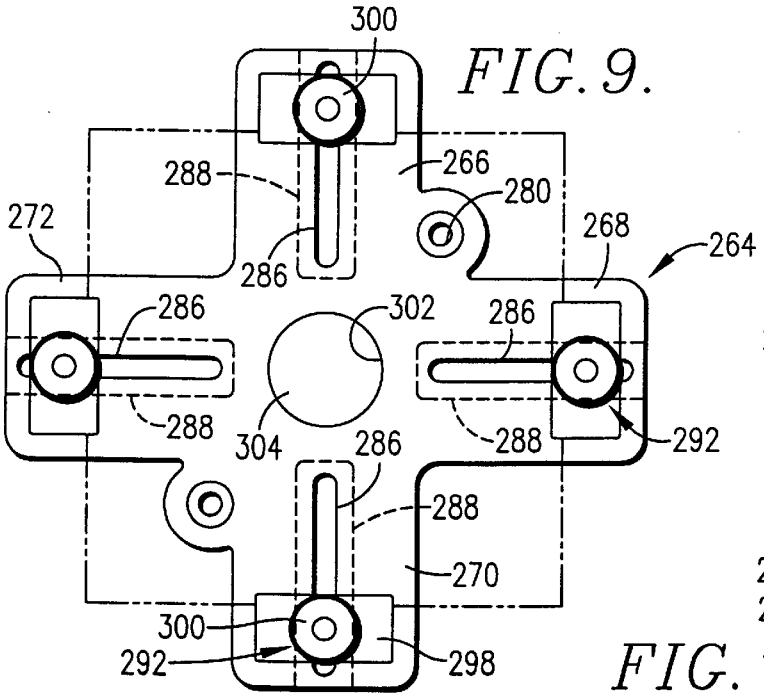
FIG. 9 is a plan view of a third form of movable support structure for supporting the graphic arts impression die plate during etching or milling thereof, and illustrating shiftable clamps for attaching the graphic arts impression die plate to the support structure, along with a central permanent magnet for holding the central part of the die against the support structure.
Figure 10:
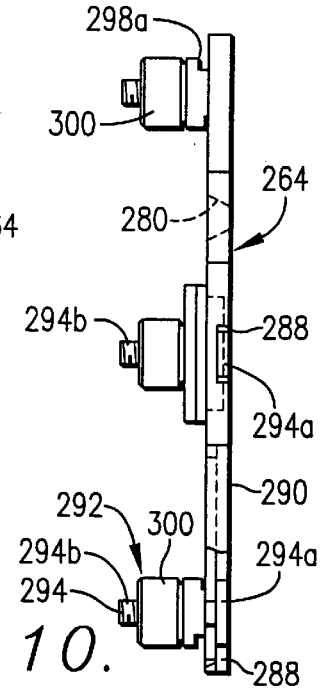
FIG. 10 is an end elevational view of the support structure shown in FIG. 9.

A further alternate embodiment of structure for supporting the blank graphic arts impression die plate during etching of the plate in apparatus 40 is illustrated in FIGS. 9 and 10 designated by the numeral 264. The magnetic support member 264 is of suitable etchant-resistant material and is also of cross-shaped configuration. The legs 266, 268, 270 and 272 of magnetic support member 264 are each provided with an elongated slot 286 therein extending longitudinally of a respective leg. Each of the legs 266, 268, 270 and 272 has an elongated groove 288 in the normally rearmost face 290 of each of the legs aligned with and of greater width than a corresponding slot 286, as indicated by the dotted line representations of FIG. 9.

A graphic arts impression die plate clamp 292 is shiftably mounted on each of the legs 266, 268, 270 and 272 for movement along the length of a respective slot 286. Each clamp 292 includes a threaded fastener 294 provided with an enlarged rectangular head portion 294*a* slidable in a respective groove 288, and an externally-threaded extension 294*b* which projects through a corresponding groove 288. The rectangular plate 298 forming a part of each clamp 292 has an opening therein (not shown) which receives a respective extension 294*b*. Each plate 298 normally extends transversely across a corresponding slot 286 and is provided with an edge groove 298*a* therein which is sized and configured to receive an edge of a blank cladded metal graphic arts impression die plate 20 carried by the magnetic support member 264. At least one nut 300 is threaded over each of the extensions 294*b* and may be rotated on the respective extension until brought into engagement with the adjacent face of a respective plate 298. Magnetic support member 264 has a relatively large circular recess 302 in the central part of the cross-shaped member in alignment with all four legs 266–272 of magnetic support member 264. A permanent magnet 304 is located within recess 302 in disposition such that the outer face of the magnet 304 is flush with the normally outermost face of the magnetic support member 264, as shown in FIG. 10. Magnet 304 may be adhesively secured to magnetic support member 264 within recess 302. Again, a pair of spaced magnets joined by a steel bridging element therebetween may be provided in lieu of the magnet 304 as depicted in FIG. 9. The magnetic support member 264 also has at least two apertures 280 therein for attachment of the magnetic support member to frame assembly 82 of etching apparatus 40.

A blank cladded metal graphic arts impression die plate 20 having design-defining photo-resist on the outer face of copper layer 24 is positioned on pre-attached magnetic support member 264 with the steel layer 22 engaging face 270 of the magnetic support member 264. After loosening of each of the nuts 300, respective clamps 292 are shifted along the length of corresponding slots 286 until the grooved portion 298*a* of each plate 298 receives a respective edge of graphic arts impression die plate 20. The grooves 298*a* are configured such that the effective height thereof is slightly less than the thickness of the graphic arts impression die plate so that when a corresponding nut 30 is tightened down on a respective extension 294, the plate 298 will engage and force the edge of the graphic arts impression die plate 20 tightly against the face 270 of magnetic support member 264.

In view of the fact that the central part of the graphic arts impression die plate 20 resting on magnetic support member 264 is magnetically attracted to and engages the magnet 304 located in the center of the magnetic support member 264, the graphic arts impression die plate 20 lays flat against the face 270 of the magnetic support member 264 throughout the extent of the graphic arts impression die plate 20, even though it is held only at the edges thereof by respective clamps 292.

Etching of the outer face of the copper layer of a blank graphic arts impression die plate 20 carried by magnetic support member 264 within etching apparatus 40 is accomplished in the same manner as with respect to magnetic support members 64 and 164.

Another alternate embodiment of the support structure or member for graphic arts impression die plate 20 is shown in FIGS. 14–16 and comprises a disc 364 generally circular configuration which is also constructed of an etchant-resistant material of the type previously described. The disc-shaped magnetic support member 364 a series of semi-circular slots 386 in the perimeter thereof for receiving attachment devices for securing the disc member to the rotatable support structure 56 of an etching machine such as the apparatus 40 as shown in FIG. 11. A number of circular openings 388 are provided in the magnetic support member 364 which extend through the thickness of the disc-shaped member.

A number of circumferentially spaced, radially extending, relatively short, elongated slots 332 are provided in one face 366 of magnetic support member 364. As is apparent from FIG. 16, the slots 332 do not extend through the full thickness of the disc-shaped member 364, but terminate in spaced relationship from the face 368 of member 364. It is also to be observed from FIG. 14 that each of the slots 332 is oriented with the longitudinal axis thereof extending through the axis of member 364.

Each of the slots 364 receives a permanent magnet 338 that may be of rectangular configuration as depicted in FIG. 16, or alternatively, two spaced magnets such as magnets 33 and 35 bridged by a steel plate 36. Each of the magnets 338 is located against the bottom surface 334 of a respective slot 332. A filler 336 of epoxy or the like retains each of the magnets 338 in position against the surface 334 of corresponding slots 332. The epoxy filler 336 may be introduced into slots 332 as a liquid and allowed to harden in place in filling relationship to a respective slot 332.

The magnets 338 are constructed and they are oriented such that the maximum magnet field emanating therefrom is present at the normally uppermost face 370 thereof. It is to be recognized that by virtue of the relatively thin portion 372 of disc 364 which remains in overlying relationship to each of the slots 332, such portion 372 does not detract to any significant degree from the magnetic properties exhibited by permanent magnets 338 embedded within slots 332.

The advantage of embedding magnets 338 in slots 332 which extend virtually all of the way through the thickness of disc 364, but in fact terminate in spaced relationship from the face 370 of the magnetic support member 364, provides a completely flat surface defined by face 370 for receipt of a graphic arts impression die plate 20 thereon. Furthermore, the relatively thin portions 372 of magnetic support member 364, which are integral with the main body of the support, fully protect the magnets from etchant solution splashed there against during etching of a graphic arts impression die plate blank removably positioned on magnetic support member 364.

Magnetic support member 364 is used in the same manner to support a graphic arts impression die plate 20 as the magnetic support members 64, 164 and 264 previously described.

Although the preferred magnetic support member 364 is provided with a plurality of circumferentially spaced and radially extending slots 332 which receive respective permanent magnets 338, in lieu of the plurality of magnets, a relatively thin, circular magnetic ferrite sheet may be adhesively or otherwise affixed to the face 370 of magnetic support member 364. The magnetic ferrite sheet should have adequate magnetic attraction to firmly hold a graphic arts impression die plate 20 to the magnetic support member 364, to substantially the same degree as is accomplished by the embodiment of magnetic support member 364 having a permanent magnet 338 within each of the slots 332. The ferrite sheet should be provided with cutouts corresponding to at least slots 386, and if desired, respective openings 388.

We claim:

1. A graphic arts impression die assembly for mounting on a support unit of graphic arts impression apparatus and comprising:

a laminated metal graphic arts impression die plate having a design-defining first, non-magnetic metal layer and a second ferromagnetic layer integral with and in supporting relationship to said first layer; and a magnetic support member for the laminated graphic arts impression die plate, said magnetic support member being adapted to be releasably secured to the support unit of the stamping or embossing apparatus and having magnetic structure located thereon in disposition to magnetically attract the graphic arts impression die plate toward the magnetic support member when the graphic arts impression die plate is positioned on the magnetic support member with the second layer of the graphic arts impression die plate in engagement with the magnetic support member.

2. A graphic arts impression die assembly as set forth in claim 1, wherein said metal graphic arts impression die plate is a cladded metal plate with the first layer thereof bonded mechanically to said second layer.

3. A graphic arts impression die assembly as set forth in claim 1, wherein said first metal layer has an etched, design-defining outer surface.

4. A graphic arts impression die assembly as set forth in claim 1, wherein said first metal layer has an engraved, design-defining outer surface.

5. A graphic arts impression die assembly as set forth in claim 1, wherein said first metal layer has an engraved and etched, design-defining outer surface.

6. A graphic arts impression die assembly as set forth in claim 1, wherein said magnetic support member has a plurality of magnetic structures thereon in spaced relationship one from another.

7. A graphic arts impression die assembly as set forth in claim 6, wherein said magnetic structures comprise a series of spaced, individual magnets.

8. A graphic arts impression die assembly as set forth in claim 6, wherein said magnetic structures comprise a series of spaced, rectangular, strip-defining magnets.

9. A graphic arts impression die assembly as set forth in claim 1, wherein said second layer of the laminated metal graphic arts impression die plate is of less transverse thickness than the maximum effective thickness of the first layer thereof.

10. A graphic arts impression die assembly as set forth in claim 9, wherein the thickness of said first layer is from about 0.020 in. to about 0.060 in., and the second layer is from about 0.008 in. to about 0.2 in.

11. A graphic arts impression die assembly as set forth in claim 10, wherein the thickness of said first layer is about 0.020 in. and the thickness of said second layer is about 0.008 in.

12. A graphic arts impression die and support assembly there for adapted to be mounted on movable structure within apparatus containing an etchant solution, comprising:

a laminated metal graphic arts impression die plate having a first, non-magnetic metal layer and a second ferromagnetic layer integral with and in supporting relationship to said first layer; and a member for supporting the laminated graphic arts impression die plate on the movable structure within said apparatus in disposition for exposure of the graphic arts impression die plate to the etchant solution, said magnetic support member having magnetic structure located thereon in disposition to magnetically attract the graphic arts impression die plate toward the magnetic support member when the graphic arts impression die plate is positioned on the magnetic support member with the second layer of the graphic arts impression die plate in engagement with the magnetic support member.

13. A graphic arts impression die and support assembly as set forth in claim 12, wherein said magnetic support member includes components for releasably mounting a magnetic support member on the movable structure of the apparatus.

14. A graphic arts impression die and support assembly as set forth in claim 12, wherein said magnetic support member is of an etchant-resistant material and has at least two oppositely extending leg portions.

15. A graphic arts impression die and support assembly as set forth in claim 14, wherein is provided magnetic structure on each of said leg portions of the magnetic support member.

16. A graphic arts impression die and support assembly as set forth in claim 15, wherein said magnetic structure comprises a series of spaced, rectangular, strip-defining magnets.

17. A graphic arts impression die and support assembly as set forth in claim 12, wherein said magnetic structure comprises a series of spaced, individual magnets.

18. A graphic arts impression die and support assembly as set forth in claim 12, wherein said magnetic structure comprises a series of spaced magnets which are not of substantially greater length than width.

19. A graphic arts impression die and support assembly as set forth in claim 12, wherein said magnetic structure comprises a series of spaced, individual disc-shaped magnets.

20. A graphic arts impression die and support assembly as set forth in claim 12, wherein said magnetic support member is of cross-shaped configuration having two pairs of oppositely extending leg portions.

21. A graphic arts impression die and support assembly as set forth in claim 20, wherein is provided magnetic structure on each of said leg portions of the magnetic support member.

22. A graphic arts impression die and support assembly as set forth in claim 21, wherein is provided magnetic structure substantially at the zone of junction of said leg portions of the magnetic support member.

23. A graphic arts impression die and support assembly as set forth in claim 12, wherein said magnetic structure comprises a substantially circular disc-shaped member.

24. A graphic arts impression die and support assembly as set forth in claim 23, wherein said disc-shaped member has a series of slots therein, each of said slots receiving magnetic structure.

25. A graphic arts impression die and support assembly as set forth in claim 24, wherein each of said slots terminates in spaced relationship from an adjacent face of the magnetic support member.

26. A graphic arts impression die and support assembly as set forth in claim 25, wherein each of said slots if provided with filler material for maintaining the magnetic structure within a respective slot.

27. A graphic arts impression die and support assembly as set forth in claim 12, wherein said magnetic structure comprises a magnetic ferrite sheet secured to and overlying one of the faces of the magnetic support member.

* * * * *